United States Patent [19]

Martin

[11] Patent Number: 4,619,488

[45] Date of Patent: Oct. 28, 1986

[54] CONNECTION ARRANGEMENT FOR AN ELECTRICALLY SCREENED SLEEVE

[75] Inventor: Sidney H. Martin, Mellor, Great Britain

[73] Assignee: International Computers Limited, London, England

[21] Appl. No.: 702,350

[22] Filed: Feb. 15, 1985

[30] Foreign Application Priority Data

Feb. 21, 1984 [GB] United Kingdom ..... 8404479

[51] Int. Cl.[4] ..... H01R 4/66

[52] U.S. Cl. ..... 339/14 R; 339/276 R; 339/125 R; 339/22 R; 29/854; 29/857; 174/68 C; 174/71 R

[58] Field of Search ..... 339/22 R, 143, 177 R, 339/177 E, 14 L, 14 R, 276 R; 29/854, 857; 174/68 C, 71 R

[56] References Cited

U.S. PATENT DOCUMENTS

| | | | |
|---|---|---|---|
| 3,120,965 | 2/1964 | MacDonald | 174/71 R |
| 3,235,651 | 2/1966 | Tepner | 174/71 R |
| 3,370,122 | 2/1968 | Ichikawa | 174/71 R |
| 4,140,870 | 2/1979 | Volkers et al. | 339/14 L |
| 4,152,538 | 1/1979 | Gassinger et al. | 29/857 |
| 4,386,814 | 6/1983 | Asick | 339/143 R |
| 4,518,819 | 5/1985 | Larsson et al. | 29/857 |

*Primary Examiner*—Gil Weidenfeld
*Assistant Examiner*—David L. Pirlot
*Attorney, Agent, or Firm*—Lee, Smith & Zickert

[57] ABSTRACT

A connection arrangement (6) located on the side of a screened sleeve (2) housing electrical cables (1) for connecting the sleeve (2) to a unit of electrical or electronic equipment. The arrangement comprises a frame (17,18,19,20) of conductive material secured to flaps (13,14,15,16) cut in the wall of the screened sleeve (2) so as to form an electrical connection between the frame and the screen of the sleeve. The frame is received into a corresponding aperture (23) in a connection plate (22) on the unit of equipment allowing electrical cables housed in the sleeve to enter the unit through the frame and the connection plate aperture while maintaining the screening at the connection.

8 Claims, 5 Drawing Figures

CONNECTION ARRANGEMENT FOR AN ELECTRICALLY SCREENED SLEEVE

BACKGROUND OF THE INVENTION

This invention relates to a connection arrangement for an electrically screened sleeve.

Such sleeves are utilised to carry electrical cables which are required for the interconnection of separate units of electronic equipment forming, for example, a computer installation. In order to maintain continuity of the screening, the screening layer of each sleeve must be connected by the connection arrangement to the conductive casing of each unit.

As a sleeve may carry many electrical cables, it is not uncommon for such sleeves to be of large diameter. It will be realised in this instance that the sleeve will be difficult to bend or form thus producing problems when the connection must be made in a restricted space.

The object of the present invention is to provide a connection arrangement which overcomes this problem.

SUMMARIES OF THE INVENTION

According to a first aspect of the invention, there is provided a connection arrangement including; a screened sleeve having a wall comprising an outer electrically insulating layer and an inner electrically conductive screening layer; electrically conductive members secured to open flaps formed in the wall so that electrical connections are produced between the conductive members and the inner layer, the conductive members forming a frame bounding an aperture left in the wall by the open flaps; and a connection plate of conductive material having an aperture therein arranged to receive the frame; the arrangement being such as to enable electrical cables housed within the sleeve to be passed through the apertures in the wall of the sleeve and the connection plate when the frame is positioned in the connection plate.

According to a second aspect of the invention there is provided a method of connecting an electrically screened sleeve for housing electrical cables to a unit of electrical equipment, the sleeve having a wall comprising an outer electrically insulating layer and an inner electrically conductive screening layer, the method including the steps of; cutting through the wall of the sleeve to produce flaps therein; extending the flaps outside the sleeve to define an aperture in the wall of the sleeve; securing electrically conductive members to the extended flaps so that electrical connection is made between the flaps and the conductive members, the conductive members forming a frame bounding the aperture; and mating the frame formed by the conductive members with an aperture in a conductive connection plate included in the unit of electrical equipment.

According to a third aspect of the invention there is provided an electrically screened sleeve for housing electrical cables, the sleeve having a wall comprising an outer electrically insulating layer and an inner electrically conductive screening layer, the sleeve including electrically conductive members secured to open flaps formed in the wall, so that electrical connections are produced between the conductive members and the inner layer, the conductive members forming a frame bounding an aperture left in the wall by the open flaps, the arrangement being adapted to mate with a connection plate of conductive material having an aperture therein arranged to receive the frame formed by the conductive members.

BRIEF DESCRIPTION OF THE DRAWINGS

One embodiment of the invention will now be described, by way of example, with reference to the accompanying drawings, in which.

DESCRIPTION OF THE PREFERRED EMBODIMENT

Figure 1:
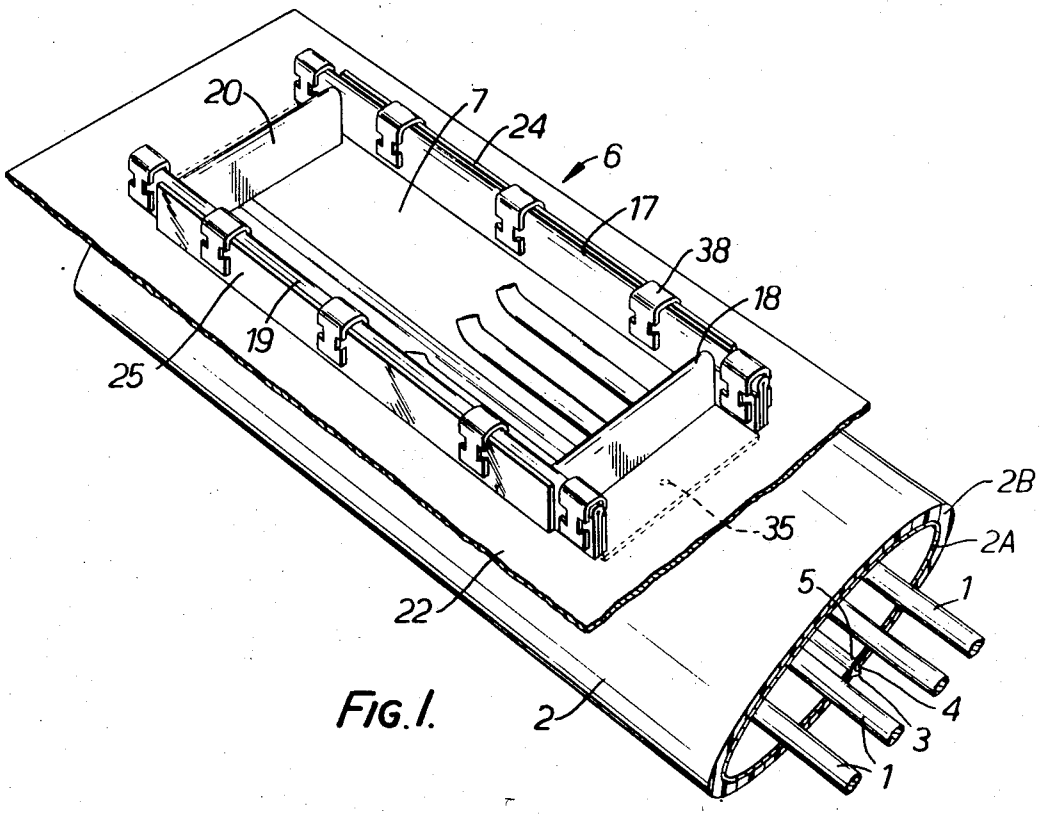
FIG. 1 is a schematic perspective view of a connection arrangement for an electrically screened sleeve.

Referring to FIG. 1 of the drawings, electrical cables 1, e.g. for the transmission of data signals, and/or other signals, are housed in a flexible sleeve 2 which is intended to provide protection, i.e. screening, against electrical signal interference. The sleeve comprises a laminate construction including an inner conductive screening layer 2A and an electrically insulating outer layer 2B. Since the sleeve 2 may be required to be fitted after installation of the electrical cables, it is split along the longitudinal direction thereof, and provided with a longitudinal fastener 3. The fastener 3 comprises a continuous beaded portion 4 along one longitudinal edge of the sleeve, and a continuous recess or groove 5 along the other longitudinal edge of the sleeve. An alternative form of the fastener comprises a hook and loop jointing system known under the Registered Trade Name Velcro. With such an arrangement the electrical cables are thus housed in a flexible tubular sleeve 2, after wrapping the cables with the sleeve and then interlocking the bead 4 and groove 5.

In order to connect one or more of the cables to a unit of electrical equipment (not shown), it is necessary to gain access to the interior of the sleeve. In gaining such access it is important that the radio frequency interference shielding should not be impaired.

For this purpose, the sleeve is provided with a connection arrangement 6, which defines a rectangular opening 7, located on the opposite side of the sleeve to the fastener 3, through which the cables can pass into the equipment.

Figure 2:
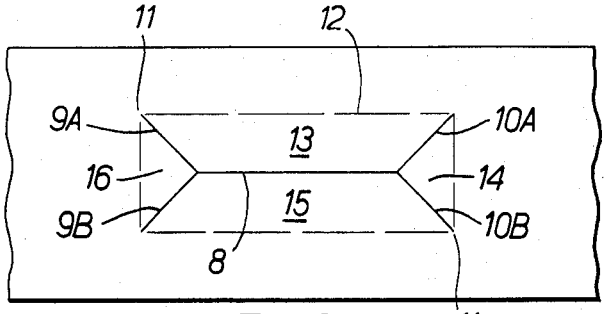
FIG. 2 shows the formation of flaps in the wall of the screened sleeve.

As illustrated in FIG. 2, this opening 7 is formed by effecting a series of through-cuts or slits in the wall of the sleeve 2. The slits are formed through both the conductive and the insulating layers 2A and 2B of the sleeve and include a first slit 8 extending lengthwise of the central line of the sleeve and, at the ends of the first slit 8, slits 9A, 9B and 10A,10B respectively, each angularly disposed to the length of the first slit 8. Each of these slits 9A,9B; 10A,10B extends from the associated end of the central slit 8 to terminate at a predetermined point 11 for the associated line end. These termination points 11 lie at the corners of a rectangle 12 that defines the size of the desired opening. The consequence of the formation of the five slits is to provide four tapered flaps 13,14,15 and 16 of which the flaps 13,15 extend lengthwise of the sleeve 2 and the flaps 14,16 extend transversely to the length of the sleeve 2.

The connection arrangement 6 includes four elongate conductive members 17,18,19 and 20 forming a rectangular frame around the opening 7. Each member has a channel of U-shaped cross-section which is firmly crimped about the associated flap 13-16 as is shown in FIG. 4.

Figure 4:
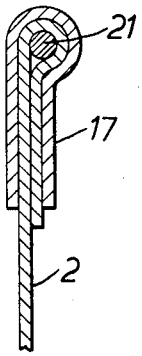
FIG. 4 shows a detail of the connection arrangement of the invention.

As will be particularly seen from FIG. 4 the material of each of the flaps 13,14,15 and 16 is folded about a length of wire, or rod 21 in such manner that its free edge overlies the remainder of the flap. The flap and rod 21 are entered into the associated U-shaped channel of member 17,18,19 or 20, which is then crimped to provide a firm mechanical grip with the folded flap and also electrical connection between the inner layer 2A and the U-shaped member. For reasons to be discussed hereinafter the length of each of the longer metal elongate members 17,19 is greater than the overall length of the flap associated therewith.

Figure 3:
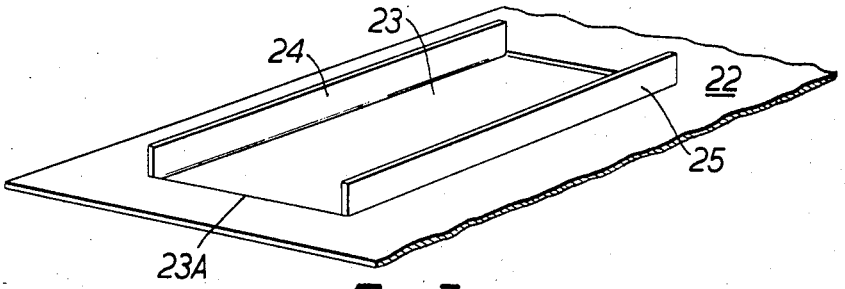
FIG. 3 shows a connection plate forming part of the arrangement.

The connection arrangement 6 also includes an electrically conductive connection plate 22 (FIG. 3) having a central opening 23. The plate 22 may be an integrally formed part of of the unit of equipment or may be a separate part attachable to the unit. The opening 23 is slightly greater in size than the opening 7 provided in the sleeve 2. The longer sides of the opening 23 terminate as elongate upstanding flanges 24,25 whose height is substantially equal to the depth of the elongate members 17,19.

Figure 5:
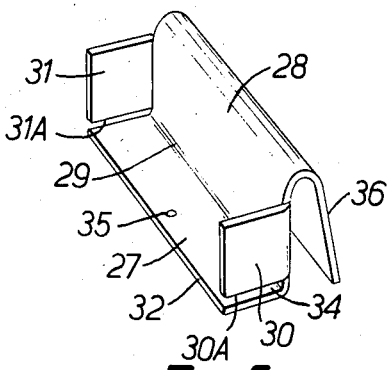
FIG. 5 is a perspective view of a further detail of the connection arrangement of the invention.

Referring now to FIG. 5, this shows one of the two shorter members 18,20 which form the rectangular frame. This member includes a rectangular base portion 27, having a length which is slightly shorter than the length of the shortest sides 23A of the rectangular opening 23 of the connection plate 22. An upstanding portion 28 extends from a first longer edge 29 of the base portion 27, this upstanding portion 28 having lugs 30,31 at each end, which extend towards the other longer edge 32 of the base portion. The lower edges 30A,31A of the lugs 30 and 31 respectively are spaced from the upper surface of the base portion 27 so as to define slots 34 adapted to receive the plate 22 in the vicinity of the shorter edge 23A of the opening 23. A raised projection 35 is provided on the base portion 27 so that on engagement of the plate 22 in the abovementioned slots 34, the plate 22 is firmly held in place and electrical connection established.

The upstanding portion 28 is provided with an extension 36 which together with the portion 28, forms the U-shaped channel of the member 18 or 20.

To install the connection arrangement on the sleeve, the flaps 13,14,15 and 16 in the sleeve are deformed upwardly away from the opening. The two members 18,20 are then fitted to the shorter end flaps 14,16 by crimping the flaps in the U-channels formed by the extensions 36 and the upstanding portions 28, after having folded the end flaps over the associated rods 21 such that the screening layer 2A of the sleeve is exposed and is thus in electrical contact with the members 18,20. The members 17,19 are then attached to the associated longer flaps 13,15 by gripping them in place after having folded the flaps over the rods.

The members 17,18,19,20 thus form a rectangular frame which is then engaged with the aperture 23 on the connection plate 22. Conveniently the longer U-shaped members 17,19 are first entered through the opening 23 of the plate 22 and positioned so that they abut the upstanding flanges 24,25 of the plate 22.

Following this, the two members 18,20 are secured in position by engagement of the slots 34, with the associated plate ends 23A. In order firmly to secure the members 17,19 in place, a series of U-shaped spring clips 38 are engaged over the flanges 24,25 and the adjacent members 17,19.

It can be seen that the connection arrangement thus provides a continuous electrical connection between the inner conductive layer 2A of the sleeve 2 and the connection plate 22, thus ensuring that there is no leakage of electrical interference at the point where the sleeve connects with the plate. It can also be seen that the connection arrangement allows connection to be made to the electrical equipment (not shown) through the side wall of the sleeve, thus avoiding the need to bend the sleeve to allow it to enter the equipment.

I claim:

1. A connection arrangement including; a screened sleeve having a wall comprising an outer electrically insulating layer and an inner electrically conductive screening layer; electrically conductive members secured to open flaps formed in the wall so that electrical connections are produced between the conductive members and the inner layer, the conductive members forming a frame bounding an aperture left in the wall by the open flaps; and a connection plate of conductive material having an aperture therein arranged to receive the frame; the arrangement being such as to enable electrical cables housed within the sleeve to be passed through the aperture in the wall of the sleeve and the connection plate when the frame is positioned in the connection plate.

2. An arrangement as claimed in claim 1, in which each electrically conductive member includes a U-shaped part crimped onto a portion of the flap folded over a rod.

3. An arrangement as claimed in claim 1 in which the frame is rectangular in shape and in which at least one of the conductive members is formed so as to clip onto an edge of the aperture in the connection plate.

4. An arrangement as claimed in claim 3, in which at least one of the conductive members abuts a turned-over portion at the edge of the aperture in the connection plate and including U-shaped spring clips securing the conductive member to the turned-over portion.

5. An arrangement as claimed in claim 4, in which an extended portion on at least one of the conductive members abuts a lug formed on an adjacent conductive member, and including further U-shaped spring clips securing the conductive members to one another.

6. An electrically screened sleeve for housing electrical cables, the sleeve having a wall comprising an outer electrically insulating layer and an inner electrically conductive screening layer, the sleeve including electrically conductive members secured to open flaps formed in the wall, so that electrical connections are produced between the conductive members and the inner layer, the conductive members forming a frame bounding an aperture left in the wall by the open flaps, the arrangement being adapted to mate with a connection plate of conductive material having an aperture therein arranged to receive the frame formed by the conductive members.

7. An electrically screened sleeve as claimed in claim 6, in which each electrically conductive member includes a U-shaped part crimped onto a portion of the flap folded over a rod.

8. An electrically screened sleeve as claimed in claim 6 including a longitudinal fastener.

* * * * *